US008246488B2

(12) United States Patent
Stevens et al.

(10) Patent No.: US 8,246,488 B2
(45) Date of Patent: Aug. 21, 2012

(54) HYBRID GOLF CLUB HEAD

(75) Inventors: Daniel M. Stevens, Cardiff, CA (US); Philip G. Foster, Carlsbad, CA (US); Wayne H. Byrne, Murrieta, CA (US); Joel B. Erickson, Pierce, NE (US)

(73) Assignee: Callaway Golf Company, Carlsbad, CA (US)

( * ) Notice: Subject to any disclaimer, the term of this patent is extended or adjusted under 35 U.S.C. 154(b) by 83 days.

(21) Appl. No.: 12/885,181

(22) Filed: Sep. 17, 2010

(65) Prior Publication Data

US 2011/0070969 A1 Mar. 24, 2011

Related U.S. Application Data

(60) Provisional application No. 61/245,612, filed on Sep. 24, 2009.

(51) Int. Cl.
*A63B 53/04* (2006.01)
*A63B 53/06* (2006.01)

(52) U.S. Cl. ..... 473/335; 473/338; 473/345; 473/349

(58) Field of Classification Search ..... 473/324–350, 473/287–292

See application file for complete search history.

(56) References Cited

U.S. PATENT DOCUMENTS

| | | | | |
|---|---|---|---|---|
| 3,941,390 | A * | 3/1976 | Hussey | 473/292 |
| 4,869,507 | A * | 9/1989 | Sahm | 473/337 |
| 5,272,802 | A * | 12/1993 | Stites, III | 29/527.2 |
| 5,447,309 | A | 9/1995 | Vincent | |
| 5,665,014 | A | 9/1997 | Sanford et al. | |
| 5,785,605 | A | 7/1998 | Helmstetter | |
| 5,911,102 | A | 6/1999 | Takahashi et al. | |
| 5,947,840 | A * | 9/1999 | Ryan | 473/335 |
| 5,985,208 | A | 11/1999 | Zedalis et al. | |
| 5,989,493 | A | 11/1999 | La Salle et al. | |
| 6,027,686 | A | 2/2000 | Takahashi et al. | |
| 6,322,746 | B1 | 11/2001 | La Salle et al. | |
| 6,350,407 | B1 | 2/2002 | Sakata et al. | |
| 6,364,788 | B1 | 4/2002 | Helmstetter et al. | |
| 6,409,612 | B1 * | 6/2002 | Evans et al. | 473/324 |
| 6,478,842 | B1 | 11/2002 | Gressel et al. | |
| 6,669,898 | B2 | 12/2003 | Gressel et al. | |
| 6,739,983 | B2 | 5/2004 | Helmstetter et al. | |
| 6,767,418 | B1 | 7/2004 | Zhang et al. | |
| 7,186,190 | B1 * | 3/2007 | Beach et al. | 473/335 |
| 7,320,646 | B2 * | 1/2008 | Galloway | 473/224 |
| 7,524,249 | B2 * | 4/2009 | Breier et al. | 473/342 |
| 2002/0160854 | A1 * | 10/2002 | Beach et al. | 473/334 |
| 2011/0053705 | A1 * | 3/2011 | Stites | 473/334 |

* cited by examiner

*Primary Examiner* — Sebastiano Passaniti

(74) *Attorney, Agent, or Firm* — Michael A. Catania; Rebecca Hanovice; Sonia Lari

(57) ABSTRACT

A hybrid type golf club head is disclosed herein. The hybrid golf club head preferably has an exterior heel weight, an exterior toe weight, and interior sole weight and a stainless steel body. The hybrid golf club head preferably has a moment of inertia Ixx about a center of gravity ranging from 2100 to 2300 grams-centimeters squared.

5 Claims, 4 Drawing Sheets

HYBRID GOLF CLUB HEAD

CROSS REFERENCES TO RELATED APPLICATIONS

The Present Application claims priority to U.S. patent application No. 61/245,612, filed on Sep. 24, 2009, which is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention relates to a hybrid golf club head.

2. Description of the Related Art

The prior art discloses many hybrid golf club heads.

The inventors wanted a hybrid that could play like an iron in the fairway and perform better from the rough. The inventors didn't like how the current hybrids would tend to hit "fliers" from the rough and lose backspin.

The inventors also wanted the golf club to slide easily through the grass and play from a variety of lies and face angles.

These features were not available in current hybrid golf clubs.

BRIEF SUMMARY OF THE INVENTION

In order to provide a hybrid with the desired qualities, the inventors moved the center of gravity forward and higher to give a trajectory more like an iron.

The inventors also designed the sole with exterior sole weights.

One aspect of the present invention is a hybrid golf club head. The hybrid golf club head includes a body comprising a crown section, a sole section and a face section. The hybrid golf club head also includes an exterior heel weight and an exterior toe weight, both positioned on the sole section. The exterior heel weight has a mass ranging from 5 to 10 grams. The exterior toe weight has a mass ranging from 5 to 10 grams. The hybrid golf club head also includes an interior weight chip positioned near the face section. The interior weight chip has a mass ranging from 4 to 8 grams. The hybrid golf club head has a moment of inertia Izz about a center of gravity ranging from 2000 to 3000 grams-centimeters squared. The hybrid golf club head has a moment of inertia Ixx about a center of gravity ranging from 1900 to 2500 grams-centimeters squared. The hybrid golf club head has a loft angle ranging from 18 degrees to 28 degrees. The hybrid golf club head has a volume ranging from 100 to 150 cubic centimeters. The hybrid golf club head has a mass ranging from 210 grams to 240 grams.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
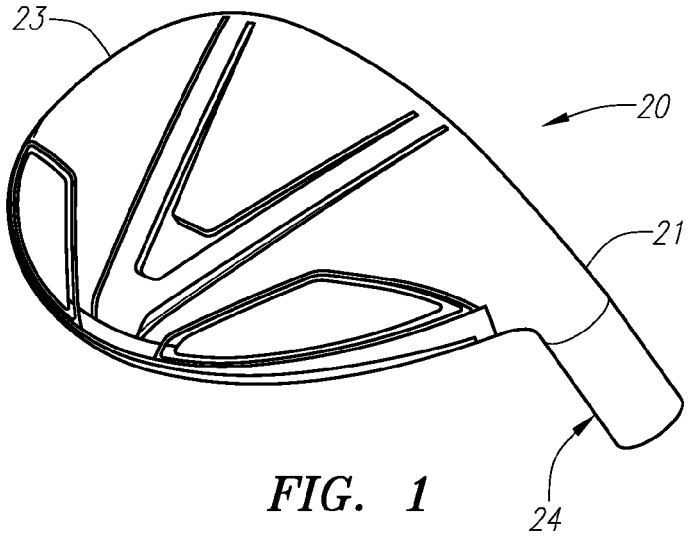
FIG. 1 is a bottom plan view of a hybrid golf club head.
Figure 2:
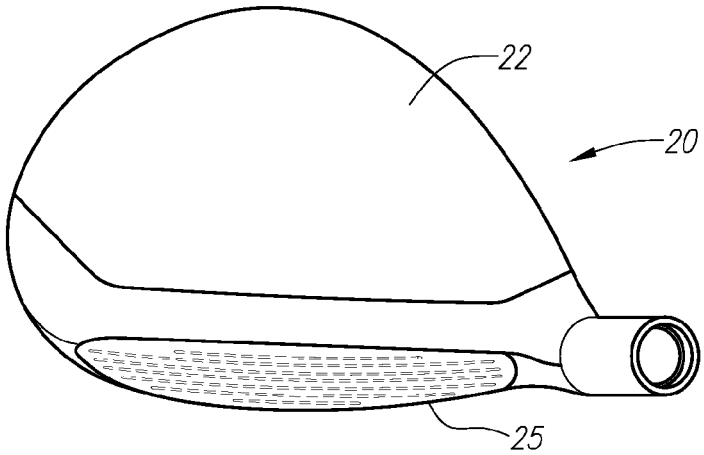
FIG. 2 is a top plan view of the hybrid golf club head of FIG. 1.
Figure 3:
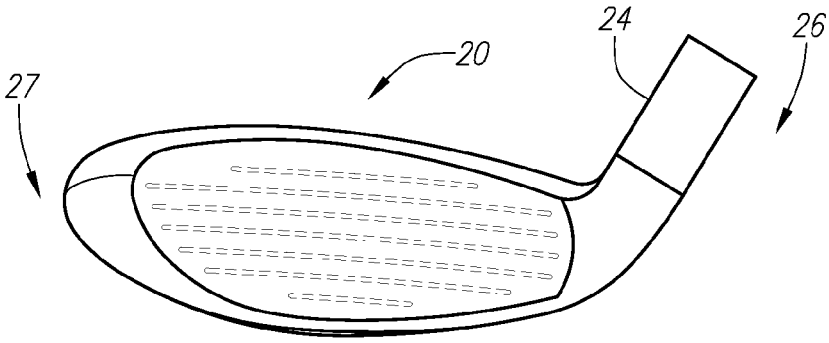
FIG. 3 is a front elevational view of the hybrid golf club head of FIG. 1.
Figure 4:
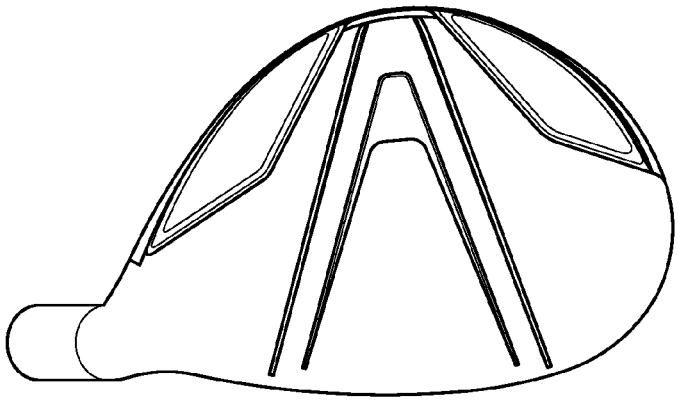
FIG. 4 is a bottom plan view of the hybrid golf club head of FIG. 1.
Figure 5:
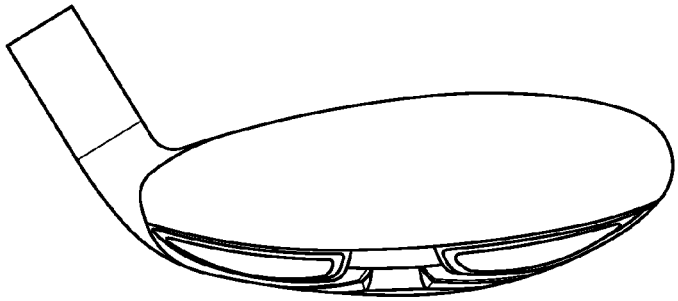
FIG. 5 is a rear elevational view of the hybrid golf club head of FIG. 1.
Figure 6:
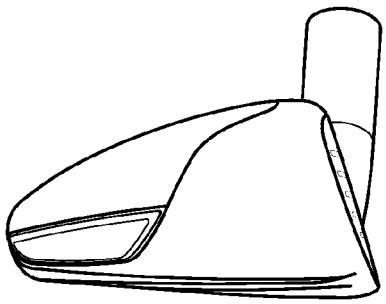
FIG. 6 is toe end side view of the hybrid golf club head of FIG. 1.
Figure 7:
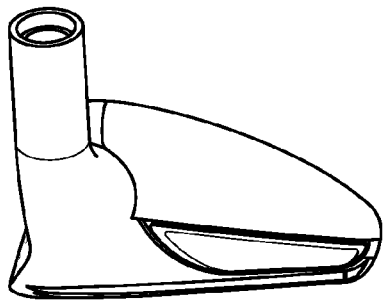
FIG. 7 is a heel end side view of a hybrid golf club head.
Figure 8:
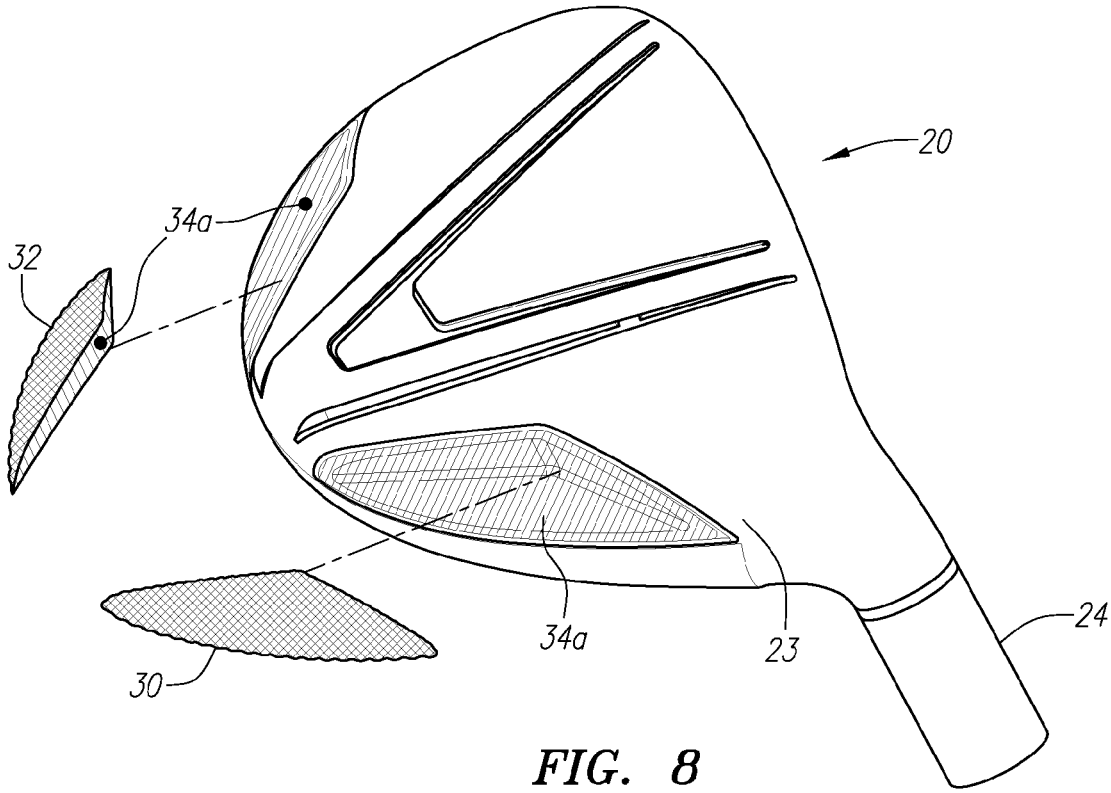
FIG. 8 is an exploded view of a hybrid golf club head with a pair of weights detached from the hybrid golf club head.
Figure 9:
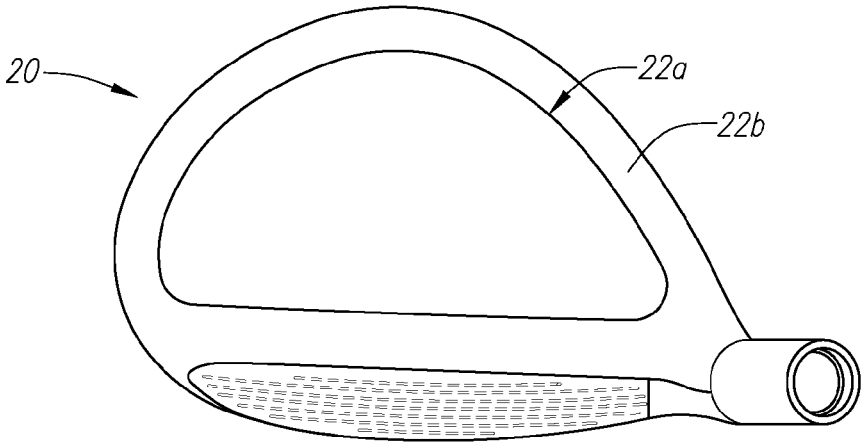
FIG. 9 is a top plan view of the hybrid golf club head illustrating a composite crown.
Figure 10:
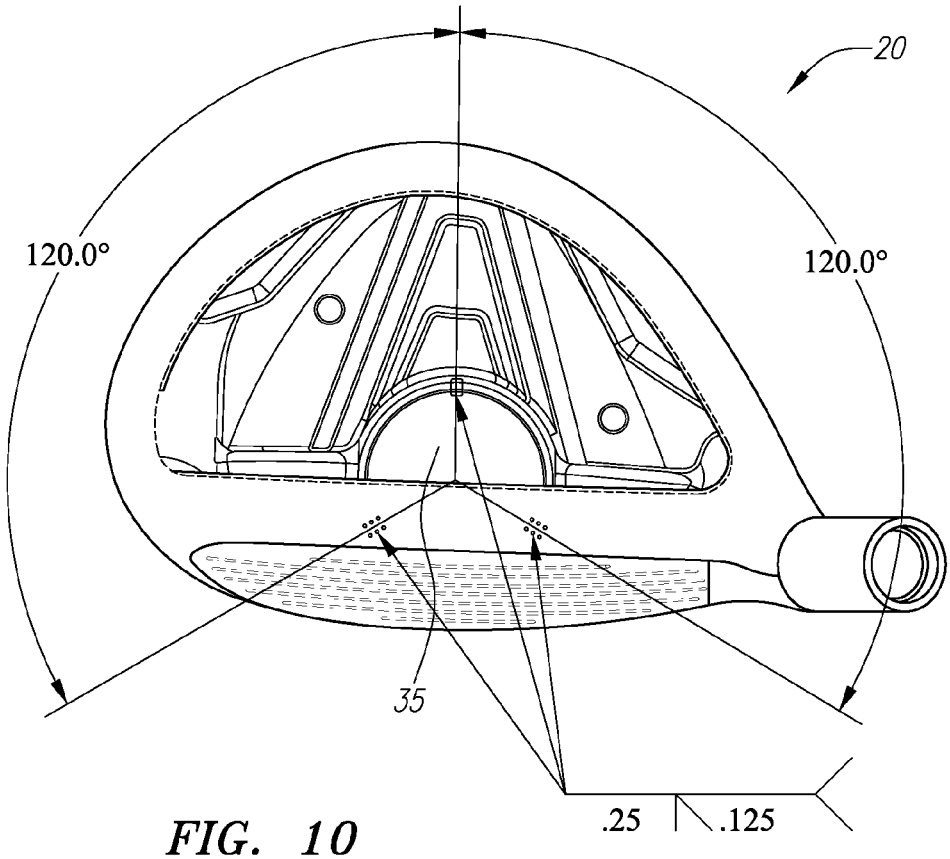
FIG. 10 is a top plan view of the hybrid golf club head with a carbon composite crown removed to illustrate the interior of the hybrid golf club head including an interior weight chip.

As shown in FIGS. 1-11, the hybrid golf club head 20 has a body 21, a crown section 22, a sole section 23, a hosel 24 and a face 25. A heel end 26 of the hybrid golf club head 20 is located on the side with the hosel 24 and a toe end 27 of the hybrid golf club head 20 opposes the heel end 26. A heel-sole weight 30 and toe-sole weight 32 are placed in recesses 34*a* and 34*b* of the sole section 23.

The body 21 is preferably composed of a stainless steel material. Alternatively, the body 21 is composed of another iron alloy material, a titanium alloy, an aluminum alloy material or the like.

Figure 11:
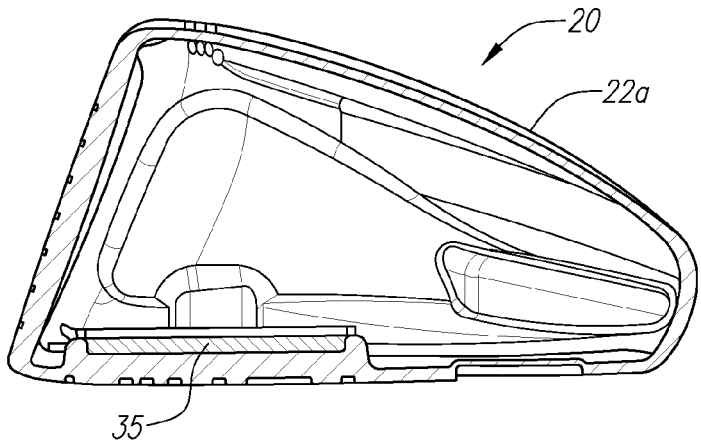
FIG. 11 is a cross-sectional view of the hybrid golf club head illustrating the interior of the hybrid golf club head including an interior weight chip.

The hybrid golf club head 20 preferably has a hollow interior 29 as shown in FIG. 11. An interior weight chip mass 35 is placed forward near the face 25 to position the CG forward. The heel-sole weight 30 and toe-sole weight 32 are bonded on the exterior of the sole section 23 to increase the moment of inertia.

A stainless steel crown section 22*a* is welded over a recess in a metal crown section 22*b*.

TABLE ONE

| Property | Value |
|---|---|
| Loft | 20 degrees |
| Lie | 58.8 degrees |
| Bulge | 14 |
| Roll | 25.0 |
| Mass | 232 grams |
| Volume | 119 cubic centimeters |
| Toe Weight Mass | 4.5 grams |
| Heel Weight Mass | 6.5 grams |
| Moment of inertia about CG, Ixx | 2255 g-cm2 |
| Moment of inertia about CG, Izz | 2490 |
| Moment of inertia about CG, Iyy | 639 |

Table One illustrates mass properties for a preferred embodiment of the hybrid golf club 20. A more thorough explanation of the moment of inertia measurements is explained in Murphy et al., U.S. Pat. No. 7,387,577, which is hereby incorporated by reference in its entirety. The Z axis lies in a crown section 22 to a sole section 23 direction, the X axis lies in a front to rear direction, and the Y axis lies in a heel to toe direction.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A hybrid golf club head comprising:

a body comprising a crown section, a sole section and a face section;

an exterior heel weight bonded in recesses on an exterior surface of the sole section, the exterior heel weight having a mass ranging from 5 to 10 grams;

an exterior toe weight bonded in recesses on the exterior surface of the sole section, the exterior toe weight having a mass ranging from 5 to 10 grams;

an interior weight chip positioned on an interior surface of the sole section near the face section, the interior weight chip having a mass ranging from 4 to 8 grams;

wherein the hybrid golf club head has a moment of inertia Izz about a center of gravity ranging from 2000 to 3000 grams-centimeters squared;

wherein the hybrid golf club head has a moment of inertia Ixx about a center of gravity ranging from 1900 to 2500 grams-centimeters squared;

wherein the hybrid golf club head has a loft angle ranging from 18 degrees to 28 degrees;

wherein the hybrid golf club head has a volume ranging from 100 to 150 cubic centimeters;

wherein the hybrid golf club head has a mass ranging from 210 grams to 240 grams.

2. The hybrid golf club head according to claim 1 wherein the body is composed of a stainless steel material.

3. The hybrid golf club head according to claim 1 wherein the body is composed of a titanium alloy material.

4. The hybrid golf club head according to claim 1 wherein the hybrid golf club head has a moment of inertia Izz about a center of gravity ranging from 2300 to 2700 grams-centimeters squared.

5. The hybrid golf club head according to claim 1 wherein the hybrid golf club head has a moment of inertia Ixx about a center of gravity ranging from 2100 to 2300 grams-centimeters squared.

* * * * *